United States Patent [19]

Nijhuis

[11] 4,103,396

[45] Aug. 1, 1978

[54] DUAL ZONE WET DRAFTING DEVICE FOR TWISTLESS YARNS

[75] Inventor: Jan Nijhuis, Hengelo, Netherlands

[73] Assignee: Hollandse Signaalapparaten B.V., Hengelo, Netherlands

[21] Appl. No.: 558,316

[22] Filed: Mar. 14, 1975

[30] Foreign Application Priority Data

Apr. 5, 1974 [NL] Netherlands ..... 7404653

[51] Int. Cl.[2] ..... D01H 5/22; D01H 5/72

[52] U.S. Cl. ..... 19/66 R; 19/288; 57/36; 57/51

[58] Field of Search ..... 57/35, 36, 164, 153, 57/51, 51.6; 19/258, 66 R, 244, 246, 288–292

[56] References Cited

U.S. PATENT DOCUMENTS

| | | | |
|---|---|---|---|
| 1,448,191 | 3/1923 | Butler | 19/288 X |
| 1,448,192 | 3/1923 | Butler | 19/290 X |
| 2,089,021 | 8/1937 | Foster | 57/35 X |
| 2,412,641 | 12/1946 | Whittier et al. | 57/35 |
| 2,493,359 | 1/1950 | Painter, Jr. | 57/35 |
| 3,020,697 | 2/1962 | Henry | 19/288 X |
| 3,131,438 | 5/1964 | Klein | 19/288 |
| 3,192,573 | 7/1965 | Nutter et al. | 19/288 X |
| 3,409,946 | 11/1968 | Whitehurst | 19/288 X |
| 3,438,094 | 4/1969 | Field, Jr. | 19/288 |
| 3,447,310 | 6/1969 | Bok et al. | 57/35 X |
| 3,877,214 | 4/1975 | Van Der Werf | 57/164 |
| 3,885,277 | 5/1975 | Schutz et al. | 57/35 X |

*Primary Examiner*—John Petrakes

*Attorney, Agent, or Firm*—Frank R. Trifari; David R. Treacy

[57] ABSTRACT

In wet-drafting an assembly of staple fibers, said assembly is drafted directly after wetting in at least two coupled drafting zones, producing together at least a 100-fold elongation. The drafting system is provided with compensating means (belt, guide and air blower) to prevent sticking of the fibers to the rollers of the drafting system and with means to control the amount of liquid between the staple fibers.

1 Claim, 1 Drawing Figure

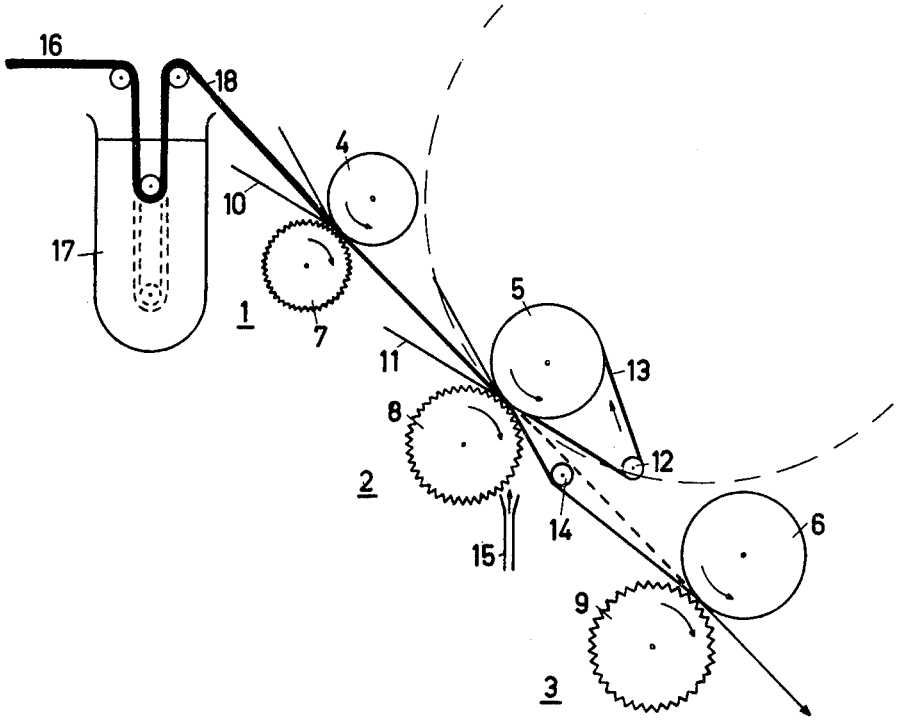
16
18
4
10
17
1
7
5
11
13
8
12
2
14
6
15
9
3

DUAL ZONE WET DRAFTING DEVICE FOR TWISTLESS YARNS

The present invention relates to a method for wet-drafting an assembly of staple fibres, the application of this method to manufacture twistless or substantially twistless yarn, the drafting means to apply this method, and the staple fibres or yarn whenever manufactured by the application of this method.

Both slivers and rovings can be subjected to wet-drafting. In view of the limit which, according to the present state of art, may be imposed on the drafting maximum possible with a single draw frame, even if this drafting occurs in a wet condition, the fineness of the drafted fibre assembly and the yarn obtained therefrom will depend on the thickness of the material supplied. Hence, only coarser staple fibres and yarn can be obtained from a sliver; for with the conventional drafting systems, accomplishing wet drafting, a maximum drafting factor of about 100 only can be attained.

It is an object of the present invention to provide a method as described in the opening paragraph, directly attaining finer staple fibres or yarns from a sliver.

According to the present invention therefore, the wet-drafting should be performed in a continuous process comprising at least two coupled drafting zones, the staple fibres entering the first zone directly after wetting, while the two zones together produce at least a 100-fold elongation.

Although this method of wet-drafting can be applied to the manufacture of all sorts of yarns, this method lends itself particularly well for the manufacture of twistless or substantially twistless yarn from a sliver which contains at least two staple fibre components, of which at least one is a potential adhesive providing for the bonding of the staple fibres, while the sliver is drafted in a wet condition to a thinner fibre strand, whereupon the yarn is obtained through bonding of this strand.

A two-cylinder drafting system, i.e. a drafting system with only one drafting zone, appears to give a too small a drafting factor, as already stated. Also a four-cylinder drafting system in practice presents difficulties in the manufacture of twistless or substantially twistless yarn. Admittedly, two two-cylinder drafting systems, separated by a false twisting unit, or a four-cylinder drafting system in which two drafting zones are separated by a tensioning zone, can be used to draft a wetted sliver direct to the required yarn thickness, but starting this process is extremely cumbersome, since the lead yarn, which is necessary to start the process of manufacturing twistless or substantially twistless yarn, can only be applied at the last rollers of the second two- or four-cylinder drafting system, as the case may be. These kinds of problems will not be encountered when a three-cylinder drafting means is used. Hence, according to the present invention, such a drafting means is preferable by applying the above-mentioned method.

The method and the drafting means thereto employed, according to the invention, are described with reference to the accompanying FIGURE.

This FIGURE illustrates an embodiment of a three-cylinder drafting means suitable for the method according to the invention. The cylinder pairs of the three-cylinder drafting means are indicated by 1, 2 and 3. Each of the pairs comprises a rubber roller 4, 5 and 6 respectively, and a serrated roller 7, 8 and 9, respectively. At the feed-in side of cylinder pairs 1 and 2 a condenser (10 and 11 respectively) is provided. A belt 13 is passed around roller 5 and a wheel 12, the belt running at a given angle to the feedthrough direction of the fibre strand being drafted. Furthermore, a guide 14 is situated between cylinder pairs 2 and 3 at the side of the jointing surface between the lines of contact of the cylinder pairs. Finally, the drafting means comprises a unit 15 to blow air along the roller 8.

In the application of the method according to the invention a sliver 16 is used, which is wetted by passing it through a liquid bath 17. The sliver to be passed through this bath should cover such a path that it can absorb sufficient liquid. This path depends, among others, upon the feedthrough rate. The time required therefore can be set by making the length of the path in bath 17 variable, as shown by the dotted lines in the accompanying FIGURE. In addition to the fact that the fibres themselves can absorb liquid, an excessive amount of liquid is absorbed between the fibres by the sliver. The time selected depends on the choice of the staple fibres being used and the thickness of the fibres.

The sliver 18 drawn out of bath 17 is fed to the three-cylinder drafting means via condenser 10 of cylinder pair 1. The function of condenser 10 is to coarsely control the excessive amount of liquid between the fibres, while also an assembly of these fibres is realised. The fine control of the amount of liquid can be realised at the feedthrough between rollers 4 and 7, for example by correctly setting the pressure exerted between these rollers, by the shape of the serration of roller 7, by the choice of the hardness of the rubber roller 4 etc. Also, through the presence of condenser 10, a smaller pressure variation between rollers 4 and 7 can be used to control the required liquid contents, taking into account the minimum clamping pressure between the rollers, as required for the drafting. The result is that sticking of the fibres to rollers 4 and 7 is much less than in the case of omitting condenser 10, in which case the pressure between rollers 4 and 7 would have to be greater in order to provide the staple fibre material being fed through with the required amount of liquid. The assembly of fibres passes the first drafting zone formed by cylinder pairs 1 and 2. Through the pressure between rollers 5 and 8 of cylinder pair 2, the fibres will also stick to these rollers if no measures are taken. For the same reason of providing condenser 10 at the feed-in side of cylinder pair 1, condenser 11 is incorporated at the feed-in side of cylinder pair 2, which is the end of the first drafting zone. It is also important that the fibres be reassembled at the end of the first drafting zone.

After extensive tests it was found that, in spite of the presence of condenser 11, cylinder pair 2 caused some fibres to be dislodged from the staple fibre assembly. This removal of loose fibres may be attributed to the sticking of these fibres to rollers 5 and 8. Hence, the assembly of fibres should be subjected to measures to overcome this problem. In the drafting system illustrated in the FIGURE, three compensating measures have been taken:

a. the provision of belt 13; this appears to prevent sticking to roller 5. An alternative would be to substantially enlarge roller 5 as shown by the dotted line in the FIGURE. The distance over which the belt extends should then approximately correspond with a part of the curved surface of the substantially enlarged roller 5. However, the use of such an enlarged roller 5 imposes a limitation on the drafting system. The effect of the belt is attributable to the more uniform distance between the surface to which the fibres may stick (the belt in the case in question) and the assembly of fibres to be fed through, thus increasing the chance that a sticking fibre will still be pulled along by the accelerating fibres;

b. the insertion of the guide 14; through a local increase of the cohesion between the fibres mutually, this guide causes an increased pulling force exerting on sticking fibres or on fibres which tend to stick.

c. the incorporation of a unit 15 to blow air along the roller 8. The function of the air stream is to disrupt the moisture film on roller 8, so that any fibres sticking to this roller can easily be pulled along by the assembly of fibres. However, this will be effective only if the roller 8 is serrated, as shown in the FIGURE, the reason being that the use of a serrated roller gives a much smaller contact area of the fibres than in the case of a smooth roller.

After the assembly of fibres has passed through the second drafting zone formed by cylinder pairs 2 and 3, the drafted fibre stand can be further processed. Thus by applying any of the conventional methods, for example as described in the Dutch patent application 72.14134 to which Canadian Pat. No. 985,885, and U.S. Pat. application Ser. No. 404,342 filed Oct. 9, 1973 and now abandoned, correspond, a sliver comprising at least two staple fibre components, of which at least one component is a potential adhesive providing for the bonding of the staple fibres may be false-twisted and bonded after the passage through the system here described.

It should be noted that in the case of manufacturing very thin yarns (24 Tex and finer) a condenser may also be required at the feed-in side of cylinder pair 3.

The method here described may be applied to single staple fibres and to staple fibres comprising several components, as well as to an assembly of fibres consisting of melting fibres or of swellable, gelatinisable or soluble fibres.

What I claim is:

1. A drafting device for wet drafting an assembly of staple fibres, comprising:

a. three cylinder pairs arranged one behind the other, so as to form first and second drafting zones;

b. first condenser means arranged at the feed-in side of the first cylinder pair, for removing most of the excess of liquid between staple fibres being drafted, and for bundling the staple fibres more compactly;

c. second condenser means arranged at the feed-in side of the second cylinder pair for bundling the staple fibres still more compactly at the end of the first drafting zone;

d. a belt passed around a first roller of the second cylinder pair and a wheel downstream of said second cylinder pair, said belt running at a given angle to a feed-through direction of the assembly of staple fibres being drafted so as to reduce fibre sticking, any fibres tending to stick being pulled along by accelerating fibres;

e. a guide positioned between the second and third cylinder pairs to one side of a direct path between lines of contact of the second and third cylinder pairs, so arranged that an assembly of fibres being drafted passes over a side of said guide remote from said path; and f. means for blowing air along a surface of a second roller of the second cylinder pair at the feed-out side of the pair in a direction opposite to the surface velocity of the second roller.

* * * * *